United States Patent [19]

Hirai et al.

[11] 4,334,921

[45] Jun. 15, 1982

[54] CONVERTER STEELMAKING PROCESS

[75] Inventors: Masazumi Hirai; Kazuo Okohira; Shozo Murakami; Hajime Nakagawa, all of Kitakyushu, Japan

[73] Assignee: Nippon Steel Corporation, Tokyo, Japan

[21] Appl. No.: 138,511

[22] Filed: Apr. 9, 1980

[30] Foreign Application Priority Data

Apr. 16, 1979 [JP] Japan ..... 54-46162
Aug. 6, 1979 [JP] Japan ..... 54-100009

[51] Int. Cl.[3] ..... C21C 5/32; C21C 5/34

[52] U.S. Cl. ..... 75/60; 75/51; 75/52; 75/59

[58] Field of Search ..... 75/52, 60, 51, 49, 59

[56] References Cited

U.S. PATENT DOCUMENTS 3,771,998 11/1973 Knuppel ..... 75/52
3,854,932 12/1974 Bishop ..... 75/49
3,953,199 4/1976 Michaelis ..... 75/60
4,089,677 5/1978 Spenceley ..... 75/51
4,178,173 12/1979 Gorges ..... 75/60
4,195,985 4/1980 Brotzmann ..... 75/60
4,198,230 4/1980 Brotzmann ..... 75/60

*Primary Examiner*—P. D. Rosenberg
*Attorney, Agent, or Firm*—Cushman, Darby & Cushman

[57] ABSTRACT

An improved converter steelmaking process that achieves a great increase in the refining capability of top-blown oxygen is provided. The process applies to an oxygen top-blowing converter that also permits bottom blowing of gas and it is characterized by supplying oxygen from a top-blowing lance and a bottom-blowing nozzle substantially throughout the refining operation, with 2 vol. % to less than 17 vol. % of a predetermined total oxygen flow rate being supplied from the bottom-blowing nozzle whereas the remaining part of oxygen is blown onto the surface of the hot metal from the top-blowing lance.

13 Claims, 2 Drawing Figures

CONVERTER STEELMAKING PROCESS

BACKGROUND OF THE INVENTION

1. Field of the Invention

This invention relates to a process for using oxygen (industrially pure oxygen, and this is hereunder referred to as oxygen) to refine pig iron in a converter or a like refining vessel. More particularly, it relates to a process for refining pig iron by supplying oxygen from above the melt together with a gas such as oxygen or a mixture of oxygen and a slow-reactive gas which is supplied from the bottom of the melt through sheath nozzles.

2. Description of the Prior Art

A steel making process that blows pure oxygen onto the surface of molten metal in a converter is conventionally known as "LD" process. When the carbon content of the melt is high, the energy produced by the impact of blown oxygen and the stirring action of carbon monoxide generated in the melt cause active refining of the iron, but when the carbon content is reduced to less than 0.8 wt%, particularly to a level close to 0.1 wt%, the formation of carbon monoxide becomes slow whereas the force of stirring the molten steel bath is weakened and the decarburizing rate is reduced. In consequence, the oxygen content in the molten steel increases rapidly to provide excess oxygen. This increases the content of iron oxides in the slag, and as a result, a sizable amount of iron and manganese is lost from the melt at the end point of the refining operation, and what is more, the yield of addition of alloy elements such as Mn, Si and Al to the molten steel is decreased. These problems have been the cause of a considerable economic loss in the LD process.

West German Pat. No. 1909779 teaches a process for refining pig iron by using sheath nozzles (comprising two coaxial pipes) which was already disclosed in French Pat. No. 1450718, and this process is characterized by supplying the iron melt with both oxygen and lime powder from beneath the converter through the inner pipe of the sheath nozzles. Hydrocarbon is supplied through the annular space between the inner and outer pipes as a coolant gas. This proposal has enabled the use of oxygen instead of air that has been employed in a Thomas converter which is the existing bottom-blown converter. It also retains the reasonable life of the converter by protecting the furnace bottom lining and sheath nozzles with the coolant gas. Therefore, the proposal has been put to commercial use under the name "OBM/Q-BOP" process.

However, even this process has the following defects. When the carbon content of the hot metal decreases and the production of carbon monoxide slows down, the hydrogen content of the molten steel increases to 4 to 6 ppm. The increased amount of hydrogen causes one problem or another in the step subsequent to the refining operation, and a certain type of steel will require dehydrogenation. What is more, since a large amount of oxygen which is very active and causes a vigorous and explosive reaction is blown from the bottom of the converter through sheath nozzles, the stirring of the melt has a tendency to go excessively. For these reasons, the process finds difficulty in slag formation of lime that is added as flux material for refining, and there is considerable slopping (the overflowing of slag and molten steel) and sticking metal skulls to the walls of the furnace mouth. Slopping can only be made less vigorous by supplying lime powder with an oxygen jet and suppressing the explosive reaction of oxygen, but to blow lime powder from the bottom of the furnace, additional sheath nozzles and hence more hydrocarbon for cooling them become necessary. This is the cause of the production of a low-carbon steel with high hydrogen content and presents other problems with equipment and maintenance that include considerable erosion of the bottom lining,, production and transport of lime powder, the technique for providing even distribution of lime powder through a plurality of nozzles, and protection against the wear of oxygen blowing pipes by lime powder. As a further disadvantage of the OBM/Q-BOP process, dephosphorization does not proceed to a satisfactory level with a high-carbon steel containing more than 0.25 wt% of carbon, and therefore, carburization becomes necessary wherein the carbon content of the steel melt must first be reduced to less than 0.10 wt% to achieve desired dephosphorization and then a large amount of a carburizing material is added to the melt being tapped.

U.S. Pat. No. 3,953,199 proposes a method which it claims eliminates the defects of the LD process and OBM/Q-BOP process. The method is basically the combination of top blowing and bottom blowing of oxygen wherein pure oxygen is blown onto the surface of the melt through a lance and at the same time pure oxygen is also blown from the bottom of the furnace through a sheath nozzle. What is unique about this method is that in the early period of refining operation, refining is substantially achieved by oxygen blown from above and when the efficiency of above blown oxygen for decarbonzation reaction begins to decrease, the oxygen supply from below is increased immediately and refining is substantially achieved by oxygen supplied from the sheath nozzle. According to the illustrated embodiment of this proposal, since lime can be added together with oxygen being supplied from above, the temperature of the slag increases to promote slag formation. In the last stage of refining by this process the carbon content of the melt is low, the production of carbon monoxide is little and the stirring of the melt is weak. In such stage, the flow rate of oxygen supplied from the sheath nozzle must be increased to about 50%, and thus, even if the flow rate of oxygen blown from below in the early and intermediate stages of refining is held to minimum level that can prevent the melt from entering the sheath nozzle, a considerable amount of oxygen is blown from below in all. Therefore, the proposed method blows a large volume of oxygen into the melt from the sheath nozzle, presenting the same problems encountered with the OBM/Q-BOP process, i.e. difficulty in forming a slag from lime, slopping, and sticking of metal skulls to the walls of the furnace mouth. To solve these problems, the process, as taught in the embodiment shown, blows a mixture of lime powder and oxygen onto the melt surface and achieves the same effect as obtained by the OBM/Q-BOP process that blows lime from below. What is more, the U.S. patent described the effect and advantage of the proposed process on a pure qualitative basis and therefore one cannot determine whether it is truly effective.

Belgian Pat. No. 780910 also describes a process that combines top blowing and bottom blowing, but its primary object is to increase thermal efficiency by using top-blown oxygen to burn the carbon monoxide generated upon reaction with bottom-blown oxygen. Therefore, it incorporates a technical concept that entirely differs from this invention which, as will be described hereunder, has for its primary object a great improvement in the refining capability of top-blown oxygen.

The refining process proposed by Belgian Pat. No. 872620 aims at increasing the thermal efficiency of a converter and increasing the charge of scrap by blowing oxygen from above as well as from below. According to this process, 20 to 80% of the total oxygen is blown on to the melt surface through nozzles installed on the side walls in the upper part of the converter and the remaining part of the oxygen is supplied from nozzles in the bottom together with lime powder. The process greatly differs from this invention with respect to the amount of oxygen to be blown from the bottom nozzle. Another difference is that according to the process of the Belgian patent, satisfactory refining is difficult without supplying powder from the bottom sheath nozzle. To be more specific, our invention limits the flow rate of bottom-blown oxygen to 2 vol% to 17 vol%, preferably from 2 vol% to 13 vol%, thereby implementing the supply of lime blocks from the furnace mouth as has been effected in the conventional top-blowing converter instead of using the complicated means of blowing lime powder from above or blowing it from below together with oxygen. This invention is capable of producing a steel whose hydrogen content is not much different from that of the steel made by the conventional top-blowing converter and it can be implemented with simpler equipment. As a further advantage, the invention maintains high refining efficiency while it assures constant lancing conditions. Such advantages of this invention cannot be expected from the processes of prior patents.

SUMMARY OF THE INVENTION

Therefore, one object of this invention is to solve the problems involved in the technology of the oxygen top-blowing steel-making process and oxygen bottom-blowing process, and to provide a novel steelmaking process of very high refining efficiency on the basis of a technical concept which entirely differs from the previously proposed process wherein top blowing is combined with bottom blowing.

Another object of this invention is to provide a converter steelmaking process that aims at increasing greatly the refining capacity of top-blown oxygen.

A further object of this invention is to provide a converter steelmaking process that intends to solve the problems that have occurred in the operation of the conventional process, such as slopping (overflowing of slag and steel melt) and spitting (throwing off of fine particles of iron).

These objects of this invention are achieved by the following methods.

(1) A steelmaking process using an oxygen top blowing converter that also permits bottom blowing of gas, characterized in that oxygen is supplied from a top-blowing lance and a bottom-blowing nozzle substantially throughout the refining operation, with 2 vol% to 17 vol% of a predetermined total oxygen flow rate being supplied from the bottom-blowing nozzle whereas the remaining part of the oxygen is blown onto the surface of the melt from the top-blowing lance.

(2) A process according to item (1) wherein a mixture of oxygen and a slow-reactive gas is supplied from the bottom-blowing nozzle so that the total flow rate of bottom-blown gas is equal to 2 to 17 vol% of the predetermined total oxygen flow rate. By the term "slow-reactive gas" is meant a gas such as argon, nitrogen, and carbon di-oxide, which is a slower or not to react with the melt than oxygen.

(3) A process according to item (1) wherein the oxygen supplied from the bottom-blowing nozzle is mixed with a slow-reactive gas only for a specified period of time.

(4) A process according to item (1) wherein the oxygen supplied from the bottom-blowing nozzle is replaced with a slow-reactive gas only for a specified period of time.

(5) A process according to any of items (1) thru (4) wherein a relatively soft oxygen jet is blown onto the surface of the melt from the top-blowing lance throughout the period of the refining operation.

(6) A process according to any of items (1) thru (4) wherein a relatively hard oxygen jet is blown in the initial stage of the refining operation and a relatively soft oxygen jet is blown in the final stage of the refining operation.

(7) A process according to item (5) or (6) wherein the force of oxygen blown onto the surface of the melt from the top-blowing lance is controlled by L/Lo (wherein Lo: the depth (mm) of stationary hot metal when the converter is in an upright position, L: the depth (mm) of penetration of top-blown oxygen jet).

(8) A process according to any of items (1) thru (7) wherein lime is supplied from the mouth of the converter within a specified period of the refining operation.

(9) A process according to any of items (1) thru (8) wherein iron ores are supplied from the mouth of the converter within a specified period of the refining operation.

(10) A process according to any of items (1) thru (9) wherein the oxygen flow rate, mixed gas flow rate or slow-reactive gas flow rate that is blown from the nozzle in the bottom of the furnace is equivalent to 2 to 13 vol% of the total oxygen flow rate.

(11) A process according to any of items (1) thru (4) wherein the gas supplied from the bottom-blowing nozzle is free from lime.

(12) A process according to any of items (1) thru (4) wherein both the gas supplied from the bottom-blowing nozzle and the oxygen supplied from the top-blowing lance are free from lime.

The process of the invention can comprise, consist essentially of or consist of the steps set forth and the material employed can comprise, consist essentially of or consist of those set forth.

DETAILED DESCRIPTION OF THE INVENTION

Figure 1:
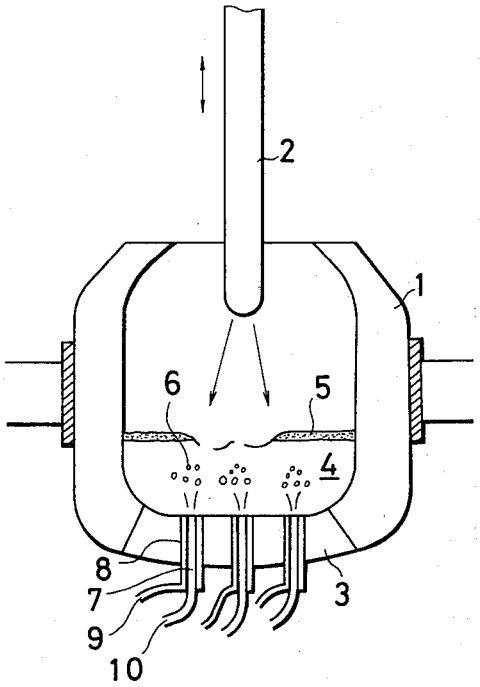
FIG. 1 is a schematic representation of one example of the refining furnace that is operated by the process of this invention.
Figure 2:
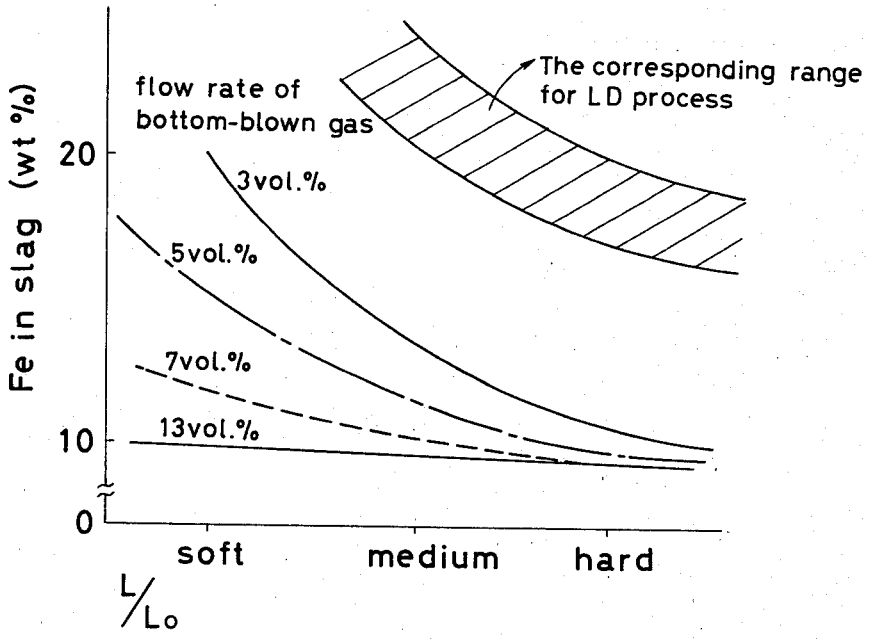
FIG. 2 is a graph showing the relation between the top-blowing conditions and the iron content in slag (wt%) which is an index of refining efficiency, as observed at 4 levels of the rate of bottom-blown gas (3 vol%, 5 vol%, 7 vol% and 13 vol%). The graph assumes a 75-t converter and a carbon content of 0.03 to 0.10 wt% at the end of blowing. It shows that at each flow rate of bottom-blown gas, the iron content in slag according to the process of this invention is smaller than that in the case of the LD process.

This invention makes low-carbon steel (C<0.10 wt%) by controlling the total Fe of slag (Fe in terms of iron oxide in slag) to about 9 to 13 wt%. By this, it achieves satisfactory dephosphorization and provides a very high Mn level at the end of blowing. In addition, the invention eliminates the defect of high hydrogen content in steel made by OBM/Q-BOP process by reducing the absolute amount of bottom-blown gas. High-carbon steels such as rail steel have been found difficult to make by the OBM/Q-BOP process unless it is combined with carburization. This invention can achieve the intended dephosphorization by making use of its ability to promote slag-metal reaction and control slag formation. Therefore, the invention has the advantage of making high-carbon steel by the catch carbon method without reducing the carbon concentration of the melt. To be more specific, the process of this invention does not have to use lime powder which is blown from the bottom together with oxygen in the OBM/Q-BOP process. Instead, it properly combines the enhanced stirring action of bottom-blown gas with the control of slag formation that is achieved by providing optimum conditions for top-blown oxygen depending upon the supply of bottom-blown gas. The result is efficient refining operation because slag can be formed from the same lime blocks as are employed in the LD process, and at the same time, the total Fe content in slag can be controlled to optimum level. In this invention, the Fe in slag can be controlled by varying the conditions for supplying oxygen from above according to the flow rate of gas supplied from the bottom of the furnace (stated more specifically, if a greater flow rate of gas is supplied from the furnace bottom, a softer oxygen jet is blown by controlling the oxygen supply and the height of the lance from the above of the furnace), and at the same time, an active metal-slag reaction is achieved by the vigorous stirring action of the bottom-blown gas. In consequence, efficient refining operation is implemented with greater uniformity in the temperatures and the chemical composition of the melt.

Dephosphorization is one of the major concerns of steelmaking. With substantially the same levels of hot metal ratio, phosphorus content in hot metal and the supply of lime, and if the carbon level at the end of refining is less than 0.10 wt% and the temperature at the end of refining is 1600°–1630° C., in order to make the phosphorus level at the end of refining equal to 0.020 wt% or less, the conventional LD converter requires a total Fe in slag of 20 to 25 wt% because the refining reaction does not proceed satisfactorily due to insufficient stirring of the melt. On the other hand, this invention requires only 9 to 13 wt% of total Fe in slag. This reduces considerably the possible loss of iron and manganese content as well as the erosion of the lining by slag. The overall result is therefore a highly efficient refining operation. It is not altogether impossible to reduce the Fe content in slag in the conventional top-blowing converter, and this could be achieved by making top-blowing conditions so hard that the oxygen jet almost reaches the furnace bottom. But such measure can not be taken in commercial operation because of the violent spitting of metal and potential hazard of erosion at the bottom of the furnace owing to the small clearance between the hot spot of oxygen jet and the furnace bottom.

According to this invention, the supply of lime powder from the bottom of the furnace is not necessary although it was indispensable to the OBM/Q-BOP process because of excessive supply of bottom-blown oxygen. Instead, the invention selects optimum conditions for the flow rate of bottom-blown gas and the supply of top-blown oxygen and achieves a very smooth refining operation. It has also been confirmed that the invention can refine low-carbon steels as well as high-carbon steels under highly practical conditions that reduce the loss of iron into slag, maintain high Mn level at the end of blowing, and provide a hydrogen level not much different from the level obtained in the LD process. As a further advantage, by blowing a nitrogen free gas from below, a steel melt containing less than 15 ppm of nitrogen at the end of blowing can be obtained regardless of its carbon content. Yet another advantage of this invention that performs refining with low total Fe content in slag is its ability to reduce and recover a manganese component from manganese ores in a far more effective manner than in the conventional LD process.

Thus, this invention not only eliminates the defects of the LD process but it also provides more efficient refining than the OBM/Q-BOP process. The invention can be implemented with a simple installation having no facilities for production and transport of lime powder, and for this reason, the conventional LD converter can be readily remodeled to accommodate the invention. Due to violent spitting and high Fe content in slag, there has been a limit on the fast refining operation in the top-blowing converter. However, in the method of this invention, since enhanced stirring of the molten metal is achieved by oxygen supplied from below, the top-blowing lance can be held high so that a large flow rate of oxygen can be blown onto the surface of the melt with a reduced impact of the oxygen jet, thereby reducing spitting. Therefore, higher efficiency of refining operation can be realized by making the total flow rate of oxygen greater than that of oxygen blown in an LD converter of a given capacity.

To develop a steelmaking process that is free from the defects of the top-blowing process and bottom-blowing process and which retains only the merits of the two processes, we performed refining by varying the proportion of flow rate of top-blown oxygen to bottom-blown oxygen as supplied during the period of refining operation, and found that if the proportion of bottom-blown oxygen exceeded about 17 vol%, the Mn content at the end of blowing was not increased appreciably, nor was the Fe content in slag reduced significantly. What is more, when the proportion of bottom-blown oxygen exceeded 17 vol% in the method of this invention that did not blow lime powder from below the converter, problems detrimental to the refining operations as slopping and spitting occurred and as a result, a great tendency of the yield of iron to drop was observed. When the proportion of bottom-blown oxygen was further increased to exceed 30 vol%, the operation was far from satisfactory because more metal skull stucks to the converter mouth walls and leaks of cooling water often occurred due to the erosion of the tip of the lance. Therefore, we set the upper limit of the proportion of bottom-blown oxygen at 17 vol%. The lower limit was set at 2 vol% for the following reasons: when both a low-carbon steel and high carbon steel are to be made using the same tuyere, a minimum value for the proportion of bottom-blown oxygen that is required to cause the stirring of the melt and to effeciently refine a more profitable low-carbon steel is 4 to 5 vol%, and thus, the minimum possible proportion of bottom-blown oxygen required for refining a high-carbon steel with the same tuyere can be reduced down to about 2 vol%. Accordingly, this invention requires that from 2 vol% to 17 vol% of oxygen be supplied from the bottom of the converter, and this is the proper range that assures improved refining efficiency obtained by the enhanced stirring action of bottom-blown oxygen and which avoids undesired problems due to excessive supply of bottom-blown oxygen without top-blowing or bottom-blowing lime powder. Moreover, when a low-carbon steel is refined in a refining furnace for exclusive use, the upper limit of bottom-blown gas flow rate of this invention is 17 vol%. However, when any of a low-carbon steel, a medium-carbon steel and high-carbon steel is refined by the use of the same refining furnace, the upper limit of the bottom-blown gas flow rate of this invention is preferably 13 vol% in order to assure improved refining efficiency. Therefore, the preferable range is from 2 to 13 vol%.

As explained above, in this invention, the lower limit of the supply of oxygen blown from below the furnace is defined as a minimum requirement for causing the stirring of the melt in a commercial converter whereas the upper limit is such that if it is exceeded, there is no latitude in controlling the properties of slag in spite of varying the conditions for the supply of top-blown oxygen and at the same time, practical operation of this invention that does not supply lime powder either from above or from below becomes difficult due to violent slopping and spitting, and as a result there is no technical rationale in combining the top blowing and bottom blowing of oxygen.

According to the process of this invention, oxygen blown from the bottom of the converter may be mixed with a slow-reactive gas such as argon, nitrogen or carbon dioxide, which may even be used independently for a specified period of time. By this modification, the making of ultra-low carbon steel becomes simpler, the addition of nitrogen is achieved for the making of a nitrogen-containing steel, or the use of hydrocarbon gas coolant is saved, resulting in a further reduction in the hydrogen content in steel.

This invention also provides a refining process that involves less slopping and is free from the deposition of metal skull on the lance by blowing oxygen from the lance onto the surface of the hot metal in a relatively soft manner throughout the refining operation or changing the blowing force between the initial and last stages of the refining and/or by providing optimum supply of iron ores and lime.

When gas blown from the bottom of the furnace passes through and escapes from the melt and slag layer, a considerably great amount of carbon monoxide and other gas that passes through the slag layer are formed as compared with the conventional top-blowing process, and depending upon the properties of the slag formed, excessive slopping will occur and refining operation will become difficult over the early and intermediate periods where an appreciable amount of carbon monoxide is produced. This is presumably because in the early period of refining, desiliconization predominates over other reactions and forms a molten slag of high $SiO_2$ content. Since this kind of slag has high viscosity and it reduces the rate at which a large amount of gas that mainly consist of carbon monoxide passes through the slag, carbon monoxide is formed at a faster rate than the gas is released from the slag. As a result, more bubbles of the gas are accumulated in the slag, which increases in volume and eventually overflows the furnace mouth. A similar phenomenon has occurred in the OBM/Q-BOP process and in one of the solutions proposed to date, a powder mainly comprising ground lime is blown from the bottom of the furnace in the early refining period depending upon the degree of desiliconization. However, since this invention is characterized by doing away with the bottom-blowing of lime powder and intrinsically, it blows a small amount of gas from below, it is practically impossible in this invention to blow an adequate supply of lime powder from below the furnace.

This invention is based on the finding that the control of both the slag composition, especially its total Fe content, and its properties is important for preventing slopping. As a result of repeated experiments, we have found that slopping can be prevented by the following method. In the early period of refining, the greater part of the required lime is supplied, preferably in separate portions, by the end of desiliconization, i.e. by the time 15 to 20 $Nm^3$ of oxygen has been blown per ton of steel, and at the same time, the supply of top-blown oxygen is made relatively more vigorous in the early period than in the last stage, and the use of iron ores in the early period is eliminated. As a result, a dry slag is obtained in the early period because the increase in the total Fe in the slag is inhibited, or the slag viscosity is reduced and the escape of gas bubbles is made easy by accelerated slag formation from CaO at a wide hot spot area which is the unique feature of this invention that supplies the greater part of the required oxygen by top-blowing, or the slag formed is cooled and inactivated by the large amount of lime charged.

As will be understood from the foregoing description as well as from the preferred embodiment which will be illustrated hereunder, the process of this invention is characterized by a lance which is positioned at a higher point than in the conventional top-blowing converter. The control of the lance height has the following effect. If the initial refining operation is so performed that the total Fe in the molten slag is high, violent slopping occurs. But by following the two procedures below, an efficient refining operation that is free from slopping can be realized: first, in the early period of refining, a relatively harder oxygen jet is supplied from above than in the last period of refining, for example, the lance position is lowered when the same amount of oxygen is supplied to make L/Lo, the ratio of the depth of cavity (L) formed by top-blown oxygen to the depth of hot metal (Lo), greater than a certain value and provide optimum total Fe content in slag, and at the same time, the formation of slag from CaO in the hot spot area is promoted, thereby performing refining operation in such a manner that a viscous molten slag mainly composed of $FeO$-$SiO_2$ will not be formed so long as the production of carbon monoxide in the melt is active in the initial period of refining. Secondly, in the last stage of refining, say, at the time when about 40 $Nm^3$ of oxygen or more has been blown per ton of steel, the position of the top-blowing lance is elevated to thereby increase the total Fe content in the slag, promote slag formation and achieve adequate dephosphorization. In short, this invention forms a molten slag of high basicity in the last stage of refining where not much carbon monoxide is generated in the melt metal, and it achieves rapid completion of dephosphorization and other refining reactions by the effect of bottom-blown gas to stirr the melt and slag vigorously. Therefore, in view of the technical concept of this invention described above, it is not desired that iron ores be used in the early period of refining, and instead, they are desirably used in separate portions during and after the intermediate period.

It is to be noted that, considering the change in the slag composition in the time course of refining, it is preferred that the formation of a viscous molten slag be inhibited in the early period by holding the total Fe content in slag as low as possible, say, at 10 wt% or less. This is because violent slopping was observed when a viscous molten slag mainly composed of $FeO\text{-}SiO_2$ and having an increased total Fe content was formed by adding iron ores or by blowing an extremely soft oxygen jet in the initial period of refining. This phenomenon can presumably be explained as follows: assuming a conventional level of hot metal ratio, the presence of residual blocks of charged scrap makes the movement of the hot metal inactive in the early period of refining and often provides a slag of high total Fe content. What is more, the iron ores added not only makes the reaction for the generation of carbon monoxide more active, but they also increase the total Fe content in slag and contribute to the formation of a viscous molten slag.

As will be clear from the above discussion, the control of the total Fe content in slag is a very important factor for the practice of this invention. If oxygen is supplied at a constant rate, such control can be achieved by changing a factor for the supply of top-blown oxygen, for example, L/Lo, depending upon the flow rate of bottom-blown gas. Alternatively, the desired control may be implemented by changing the oxygen supply rate. To be more specific, by increasing the oxygen supply rate while the flow rate of bottom-blown oxygen and L/Lo are held constant, FeO can be produced at a faster rate, thus increasing the total Fe level of slag.

It is to be noted that the depth of cavity formed in the melt by oxygen jet supplied from the top-blowing lance is to be determined by the following formulae:

$$L = A\exp\left(-\frac{0.78h}{A}\right) \quad (1)$$

$$A = 63.0\left(\frac{kF_{O2}}{nd}\right)^{\frac{2}{3}} \quad (2)$$

wherein h: the lance height (mm), or the distance between the lance tip and the surface of a stationary melt;

A: L (mm) when h=0 and this is determined by formula (2);

$F_{O2}$: oxygen feed rate ($Nm^3/hr$);

n: the number of nozzle holes in the top-blowing lance;

d: nozzle diameter (mm); and k: a constant determined by nozzle angle ($\theta$) (see below).

| $\theta°$ | 0 | 6 | 8 | 10 | 12 |
|---|---|---|---|---|---|
| k | 1.73 | 1.44 | 1.27 | 1.08 | 1.00 |

Therefore, L/Lo can be changed by varying one of the following factors, lance height (h), top-blowing nozzle hole diameter (d) and jet flow rate or oxygen feed rate ($F_{O2}$). Preferably, in actual operation, the lance height (h) is varied.

Therefore, this invention limits the flow rate of bottom-blown oxygen to a range of from 2 vol% to 17 vol%, preferably from 2 to 13 vol%, of the total oxygen supply, and in consequence, the complicated means of blowing lime powder together with top-blown oxygen or bottom-blown oxygen can be replaced by simple supply of lime blocks from the furnace mouth as has been effected in the conventional top-blowing converter. According to this invention, low-carbon as well as high-carbon steels can be made at low cost without losing much iron or manganese content and without increasing the oxygen content in the melt. Accordingly, the loss of additional alloy elements such as aluminum, manganese and silicon due to oxidation is held to a minimum, and at the same time, efficient recovery of manganese from manganese ores can be realized. What is more, due to reduced supply of bottom-blown oxygen, a steel whose hydrogen content is not much different from that of the steel made by the conventional LD process is produced. A further reduction in the hydrogen content of steel can be achieved or the making of an ultra-low carbon steel can be rendered even simpler by supplying a mixture of bottom-blown oxygen with a slow-reactive gas such as argon, nitrogen or carbon dioxide, which mixture comprises 80 vol% or less of the oxygen and 20 vol% or more of the slow-reactive gas, for a suitable period of time or using such gas independently for a short period of time. As a further advantage, mixing nitrogen gas with bottom-blown oxygen results in the addition of nitrogen that is necessary for the making of a nitrogen-containing steel, and, to the contrary, by using a bottom-blown gas which does not contain substantially nitrogen, the final nitrogen content of steel can be reduced to 15 ppm or less. Moreover, large size scrap can be used by applying the bottom-blown gas, which can give additionally strength to stir, although this has been used only in a limited volume in the conventional top-blowing converter. Therefore, this invention has desirable features both metallurgically and economically, and it provides a steelmaking process which is of high technological value in the following points: it can be operated with a simple installation because it requires a smaller number of tuyeres and there is no need of blowing lime powder; the top-blowing converter which is currently used all over the world can be readily remodeled to a converter suitable for the implementation of this process; maintenance of the installation and refractory brickwork at the furnace bottom can be achieved at low cost; and overall production efficiency can be increased.

The process of this invention was operated with a 75-t top-blowing converter which is schemtically represented in FIG. 1. The converter per se is known, and it has an oxygen top-blowing lance hanging above the converter and three sheath nozzles each comprising two coaxial pipes and which are also known per se. In the figure, 1 is a furnace, 2 is an oxygen top-blowing lance, 3 is a furnace bottom, 4 is a molten metal, 5 is a slag, 6 is a bottom-blown gas and 7 is the inner pipe of a bottom-blowing sheath nozzle. During refining operation, pure oxygen was supplied through the inner pipe, and at the time of charging hot metal before refining and at the end of refining, a slow-reactive gas was supplied for the purpose of preventing nozzle plugging. The reference numeral 8 indicates the outer pipe of the sheath nozzle. Through the clearance between the inner pipe 7 and outer pipe 8, hydrocarbon gas, oil like kerosene, or oil mist comprising oil atomized with a neutral gas was flowed during the refining operation as a coolant for preventing the erosion of the pipes and bottom lining, but as in the case of the inner pipe 7, a slow-reactive gas was caused to flow through said clearance both at the time of charging hot metal and at the end of the refining operation. A pipe 10 was connected to a gas tank (not shown) through an apparatus (not shown) for controlling the flow rate of oxygen or slow-reactive gas to be flowed through the inner pipe. A pipe 9 was connected to another gas tank (not shown) through an apparatus (not shown) for controlling the flow rate of the coolant gas such as hydrocarbon gas and slow-reactive gas or a slow-reactive gas. The inner pipe of the bottom-blowing nozzle was supplied with oxygen or a mixture of oxygen with a slow-reactive gas. In the refining operation, we changed the flow rate of the gas or the type of gas flowing through the inner pipe in order to prevent slopping, reduce the hydrogen content in steel and to increase the nitrogen content in steel. Propane gas was supplied through the clearance between the inner pipe and the outer pipe except that only a slow-reactive gas was supplied when the inner pipe was supplied with a mixture of oxygen and a slow-reactive gas or only a slow-reactive gas. The flow rate of gas flowing through the inner pipe was changed by varying the diameter of the sheath nozzle.

Before starting refining operation, the furnace was charged with about 10 tons of scrap and 65 tons of hot metal while a minimum amount of argon or nitrogen gas that was required to prevent nozzle plugging was supplied through the inner pipe 7 as well as through the clearance between the inner pipe and outer pipe 8. Then, the furnace was brought to an upright position, the top-blowing lance 2 was lowered to a predetermined height, and the refining operation was started. Subsequently, oxygen was caused to flow through the inner pipe 7 and propane through the clearance between the inner pipe 7 and outer pipe 8. During the refining operation, the height of the top-blowing lance 2 was controlled properly depending upon the type of steel to be made and the flow rate of the bottom-blown gas. In the course of the refining, flux materials, such as lime, iron ores and fluorspar were supplied from the furnace mouth. When the silicon content of the hot metal was high, the occurrence of slopping in the initial as well as the intermediate periods of refining could be effectively prevented by supplying the greater part of lime and fluorspar in the first half period of the refining and by supplying the greater part of iron ores in the intermediate period and onward after active decarburization was over. When the blowing of a predetermined supply of oxygen was over, the supply of oxygen from the top-blowing lance 2 was finished and at the same time, argon or nitrogen was supplied from both the inner pipe and the clearance between the inner and outer pipes. The furnace was tilted, and the effect of the process of this invention was checked by temperature measurement and chemical analysis of selected samples of the steel melt.

TABLE 1

| | | blowing conditions | | | | | | | | | | | | |
|---|---|---|---|---|---|---|---|---|---|---|---|---|---|---|
| | | top-blowing | | bottom-blowing | | | | chemical analysis at the end of blowing | | | | | | |
| | | | | | | | | melt | | | | | | |
| | case No. | percent top-blown oxygen (vol. %) | top-blown lancing condition (L/Lo) | percent bottom-blown oxygen (vol. %) | percent total bottom-blown gas (vol. %) | timing of mixing slow-reactive gas | total Fe in slag (wt. %) | C (wt. %) | Mn (wt. %) | P (wt. %) | H (ppm) | N (ppm) | refining status | remarks |
| our invention | 1 | 97.5% | medium (0.55) | 2.5% | — | — | 11 | 0.40 | 0.28 | 0.020 | 2.0 | 13 | good | |
| | 2 | 94 | medium→ soft (0.55)(0.40) | 6 | — | — | 11 | 0.30 | 0.27 | 0.020 | 2.2 | 12 | " | |
| | 3 | 94 | medium→ soft (0.55)(0.40) | 6 | — | — | 12 | 0.05 | 0.22 | 0.016 | 2.3 | 11 | " | |
| | 4 | 87.5 | medium→ soft (0.55)(0.40) | 12.5 | — | — | 11 | 0.05 | 0.23 | 0.017 | 2.5 | 10 | " | |
| | 5 | 87.5 | soft (0.38) | 12.5 | — | — | 13 | 0.04 | 0.18 | 0.016 | 2.4 | 10 | medium slopping | high Si hot metal (Si = 1.1 wt. %) |
| | 6 | 87.5 | hard→ medium (0.65)(0.50) | 12.5 | — | — | 8 | 0.06 | 0.28 | 0.026 | 2.6 | 12 | metal skull deposited at lance tip | |
| | 7 | 87.5→ 100 | medium→ soft (0.58)(0.40) | 12.5→ 0 | 10 (Ar) | last stage (4 min) | 28 | <0.01 | 0.09 | 0.010 | 2.0 | 14 | good | (ultra-low carbon) Ar flowed between inner and outer pipes in last refining stage |
| | 8 | 97.5 | medium→ soft (0.58)(0.40) | 2.5% | 12.5 ($O_2$:$N_2$ = 1:4) | throughout | 12 | 0.06 | 0.23 | 0.018 | 2.0 | 75 | good | $N_2$ flowed between inner and |

TABLE 1-continued

| | case No. | blowing conditions: top-blowing: percent top-blown oxygen (vol. %) | top-blowing: top-blown lancing condition (L/Lo) | bottom-blowing: percent bottom-blown oxygen (vol. %) | bottom-blowing: percent total bottom-blown gas (vol. %) | bottom-blowing: timing of mixing slow-reactive gas | chemical analysis at the end of blowing: total Fe in slag (wt. %) | melt: C (wt. %) | melt: Mn (wt. %) | melt: P (wt. %) | melt: H (ppm) | melt: N (ppm) | refining status | remarks |
|---|---|---|---|---|---|---|---|---|---|---|---|---|---|---|
| | | | | | | | | | | | | | | outer pipes |
| | 9 | 84.5→ 90 | medium→ soft (0.55)(0.39) | 15.5→ 10 | — | — | 11 | 0.05 | 0.24 | 0.017 | 3.0 | 11 | " | Flow rate of bottom-blown gas varied |
| | 10 | 83→ 90 | medium→ soft (0.58)(0.40) | 17→ 10 | 20 ($O_2$:Ar=1:1) | last stage (2 min) | 10 | 0.07 | 0.25 | 0.018 | 1.8 | 12 | mild slop-ping | high Si hot metal (Si = 0.90 wt. %) Ar flowed between inner and outer pipes in last refining stage |
| | 11 | 83→ 97.5→ 83 | medium→ soft (0.58)(0.40) | 17→ 2.5→ 17 | 12.5 ($O_2$:$N_2$=1:4) | inter medi-ate stage (4 min~ 6 min) | 10 | 0.06 | 0.25 | 0.018 | 2.5 | 17 | good | high Si metal (Si = 0.95 wt. %) Ar flowed between inner and outer pipes in last refining stage |
| con-ven-tion-al ex-am-ple | 12 | 75→ 80 | medium→ soft (0.55)(0.40) | 25→ 20 | — | — | 8 | 0.05 | 0.30 | 0.025 | 3.5 | 13 | violent slop-much metal skull de-posited at lance tip | refining difficult |
| | 13 | 100 | hard (0.8) | o | o | — | 22 | 0.05 | 0.15 | 0.016 | 2.0 | 20 | mild slop-ping | conven-tional LD process |

In Table 1, percent top-blown oxygen, percent bottom-blown oxygen, and percent total bottom-blown gas are expressed by the following formulae:

$$\text{Percent top-blown oxygen} = \frac{\text{flow rate of top-blown oxygen}}{\text{total oxygen flow rate (i.e. flow rate of top-blown oxygen + flow rate of bottom-blown oxygen)}} \times 100$$

$$\text{Percent bottom-blown oxygen} = \frac{\text{flow rate of bottom-blown oxygen}}{\text{total oxygen flow rate}} \times 100$$

$$\text{Percent total bottom-blown gas} = \frac{\text{flow rate of bottom-blown oxygen (i.e. flow rate of bottom-blown oxygen + flow rate of bottom-blown slow-reactive gas)}}{\text{total oxygen flow rate}} \times 100$$

In "top-blowing lancing condition" columns of Cases Nos. 1 to 12, "hard" means L/Lo of 0.6 or more, "medium" L/Lo of more than 0.4 to less than 0.6, and "soft" L/Lo of 0.4 or less. In "top-blowing lancing condition" column of Case No. 13, "hard" means L/Lo of 0.8.

The entire disclosures of Japanese priority applications (Serial No. 46162/79 filed on Apr. 16, 1979 and Serial No. 100009/79 filed on Aug. 6, 1979) are hereby incorporated by reference.

What is claimed is:

1. A steelmaking process comprising supplying oxygen from a top-blowing lance and a bottom-blowing nozzle substantially throughout the refining operation, with 2 vol% to 17 vol% of a predetermined total oxygen flow rate being supplied from the bottom-blowing nozzle whereas the remaining part of the oxygen is blown onto the surface of the melt from the top-blowing lance.

2. A process according to claim 1 wherein a mixture of oxygen and a slow-reactive gas is supplied from the bottom-blowing nozzle so that the total flow rate of bottom-blown gas is equal to 2 to 17 vol% of the predetermined total oxygen flow rate.

3. A process according to claim 1 wherein the oxygen supplied from the bottom-blowing nozzle is mixed with a slow-reactive gas only for a specified period of time.

4. A process according to claim 1 wherein the oxygen supplied from the bottom-blowing nozzle is replaced with a slow-reactive gas only for a specified period of time.

5. A process according to any of claims 1 to 4 wherein a relatively soft oxygen jet is blown onto the surface of the melt from the top-blowing lance throughout the period of the refining operation.

6. A process according to any of claims 1 to 4 wherein a relatively hard oxygen jet is blown in the initial stage of the refining operation and a relatively soft oxygen jet is blown in the final stage of the refining operation.

7. A process according to claim 1 wherein the force of oxygen blown onto the surface of the melt from the top-blowing lance is controlled by L/Lo where Lo: the depth (mm) of stationary hot metal when the coverter is in an upright position, L: the depth (mm) of penetration of top-blown oxygen jet.

8. A process according to claim 1 wherein lime is applied from the mouth of the converter within a specified period of the refining operation.

9. A process according to claim 1 wherein iron ores are supplied from the mouth of the converter within a specified period of the refining operation.

10. A process according to claim 1 wherein the oxygen flow rate, mixed gas flow rate or slow-reactive gas flow rate that is blown from the nozzle in the bottom of the furnace is equivalent to 2 to 13 vol% of the total oxygen supply.

11. A process according to any of claims 1 to 4 wherein the gas supplied from the bottom-blowing nozzle is free from lime.

12. A process according to any of claims 1 to 4 wherein both the gas supplied from the bottom-blowing nozzle and the oxygen supplied from the top-blowing lance are free from lime.

13. A process according to claim 1 comprising controlling the total iron of the slag to about 9 to 13 weight %.

* * * * *